US007341548B2

(12) United States Patent
Heitzman et al.

(10) Patent No.: US 7,341,548 B2
(45) Date of Patent: Mar. 11, 2008

(54) BALL AND FRAME EXERCISING APPARATUS

(75) Inventors: Charles J. Heitzman, 1330 Ala Moana Blvd., Honolulu, HI (US) 96813; Christopher F. Pepe, Honolulu, HI (US)

(73) Assignee: Charles J. Heitzman, Honolulu, HI (US)

( * ) Notice: Subject to any disclaimer, the term of this patent is extended or adjusted under 35 U.S.C. 154(b) by 86 days.

(21) Appl. No.: 11/130,999

(22) Filed: May 17, 2005

(65) Prior Publication Data

US 2005/0261114 A1 Nov. 24, 2005

Related U.S. Application Data

(60) Provisional application No. 60/571,802, filed on May 18, 2004.

(51) Int. Cl.
*A63B 26/00* (2006.01)

(52) U.S. Cl. ..... 482/142; 482/91

(58) Field of Classification Search ..... 482/121–130, 482/140; 446/220

See application file for complete search history.

(56) References Cited

U.S. PATENT DOCUMENTS 3,635,528 A * 1/1972 Strom ..... 297/452.41
3,899,210 A * 8/1975 Samhammer et al. .... 297/448.2
4,438,919 A * 3/1984 Gamzo ..... 472/134
5,690,389 A * 11/1997 Ekman et al. ..... 297/452.41
6,070,943 A * 6/2000 Guery-Strahm ..... 297/452.41
6,375,601 B1 * 4/2002 Johnson ..... 297/452.41
6,447,070 B1 * 9/2002 Ekman et al. ..... 297/452.41
6,461,284 B1 * 10/2002 Francavilla ..... 482/142
6,520,578 B1 * 2/2003 Jospa et al. ..... 297/217.1
D471,025 S * 3/2003 Chiu ..... D6/366
D471,371 S * 3/2003 Chiu ..... D6/366
6,601,922 B2 * 8/2003 Doolan et al. ..... 297/466
6,616,238 B1 * 9/2003 Guery-Strahm ..... 297/452.41
6,702,388 B1 * 3/2004 Chiu ..... 297/452.41
6,832,817 B1 * 12/2004 Chiu ..... 297/452.41
D503,553 S * 4/2005 Chiu ..... D6/352
D509,548 S * 9/2005 Heitzman et al. ..... D21/662
7,044,558 B2 * 5/2006 Chiu ..... 297/452.41
7,118,517 B1 * 10/2006 Hale ..... 297/448.2
2005/0261114 A1 * 11/2005 Heitzman et al. ..... 482/142

* cited by examiner

*Primary Examiner*—Lori Amerson
(74) *Attorney, Agent, or Firm*—Jacox, Meckstroth & Jenkins

(57) ABSTRACT

A resilient exercising ball is confined within a frame which defines a space around the ball so that the ball has limited universal movement. The ball is normally centered within the frame by elastic members or cords having end portions attached to the frame. The ball stretches the cords until the ball is supported by a base surface or floor, and the ball rolls horizontally within the space in response to movement of the person's body. The frame may be in the form of a rigid tubular chair with arm rests or in a circular configuration with a flexible ball support pad connected to the frame by elastic cords. The frame may also have a V-shaped configuration and be formed by releasably connected tubular sections having interfitting end portions.

22 Claims, 2 Drawing Sheets

BALL AND FRAME EXERCISING APPARATUS

BACKGROUND OF THE INVENTION

The benefits of exercising on a resilient ball as a fitness tool are well known. The ball is one of the most enjoyable, affordable and versatile exercise tools available. It has been used with low level neurological patients, rehabilitation, acute pain patients as well as with healthy school children and world class athletes. Exercising on the ball can be used by all ages from toddlers to seniors and adapted for use with groups of different abilities. The exercise concept is that movement on the ball changes the center of gravity of the user and causes the user's abdominal core muscles to tighten automatically to maintain balance.

SUMMARY OF THE INVENTION

The present invention is directed to exercising apparatus for improving the user's flexibility, balance, and body strength. As a centerpiece, a resilient ball is used to support the user's body weight in a sitting position. The ball is free standing and positioned in the center of a frame which captures and contains the ball, but with space provided so that the ball is free to move laterally or horizontally within the frame in response to the user's exercise motions. The ball has universal movement within the frame. The user's legs, waist, back, arms and head are all free to move for a full body workout. The user sits on the ball, like sitting in a chair. The frame may have arms to be used for stability, to maintain balance and for getting up and out of the exercising apparatus. Combining a chair-like frame or a surrounding frame with a ball makes it easier for the user to workout on the ball and maintain stability. The ball is normally supported centrally with respect to the frame by a plurality of elastic members such as elastic rubber cords or straps. The combination of the ball and frame provides for a larger spectrum of users and age groups and for an expanded, safer way to exercise on the ball.

DESCRIPTION OF THE PREFERRED EMBODIMENTS

Figure 1:
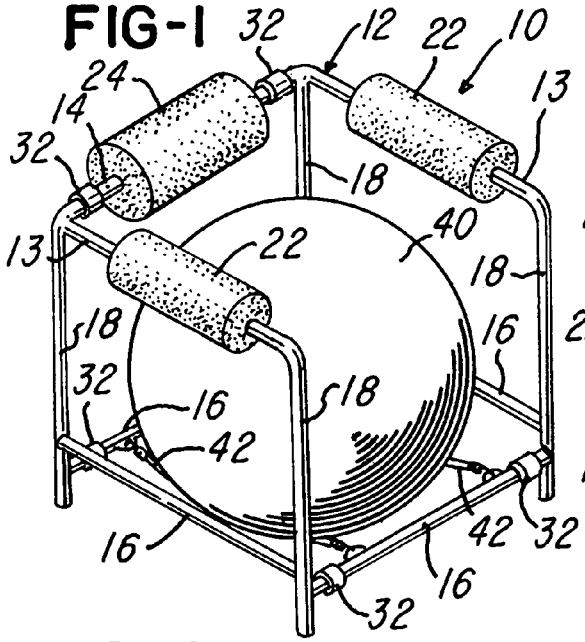
FIG. 1 is a perspective view of exercising apparatus constructed in accordance with the invention.

Referring to FIG. 1, an exercising apparatus 10 includes a chair-like frame 12 having rigidly connected frame members including side arm rails 13, a back rail 14, lower frame members 16 and vertical legs or frame members 18, all of which may be rigid tubes of plastic or metal. The arm rails 13 and back rail 14 support resilient foam cylindrical pads 22 and 24, respectively, to provide arm and back cushions. The frame 12 also includes socket couplings 32 releasably connecting the frame members to facilitate storage and shipping of the frame 12. An inflatable and resilient exercising ball 40 is confined within the frame 12 which forms an oversize enclosure for the ball 40. The ball is centered within the frame 12 by the centering means or members, for example, in the form of at least two elastic cords 42 connected to front and rear parallel frame members 16 by wire formed eyelets or hooks 43 and wire loops 44. The cords 42 and wire formed hooks 43 are of the conventional type such as a "Bungee Cord", but the hooks may be made so that an end portion of the wire extends into a hole within the frame members 16, thereby eliminating the need for the loops 44.

The user sits on the ball 40 which engages the floor F and supports the entire body weight of the user. By moving the body around, such as by lifting legs and holding arms out one at a time, the body movement on the ball changes the body center of gravity and causes the abdominal core muscles to tighten automatically to maintain balance. This form of exercise results in an increase in strength, flexibility and balance. The user may steady himself or herself by holding on to the upper side frame members or arm rails 13.

Figure 2:
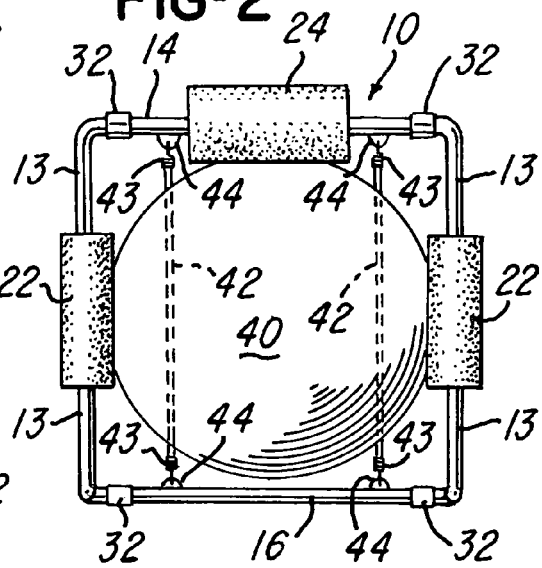
FIG. 2 is a top view of the apparatus shown in FIG. 1.
Figure 3:
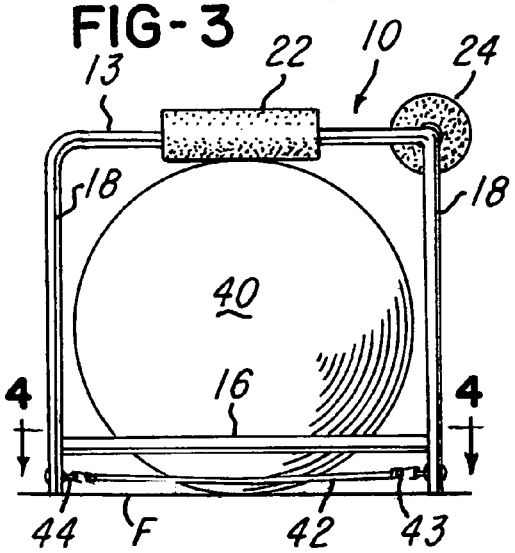
FIG. 3 is a side view of the apparatus shown in FIGS. 1 & 2.
Figure 4:
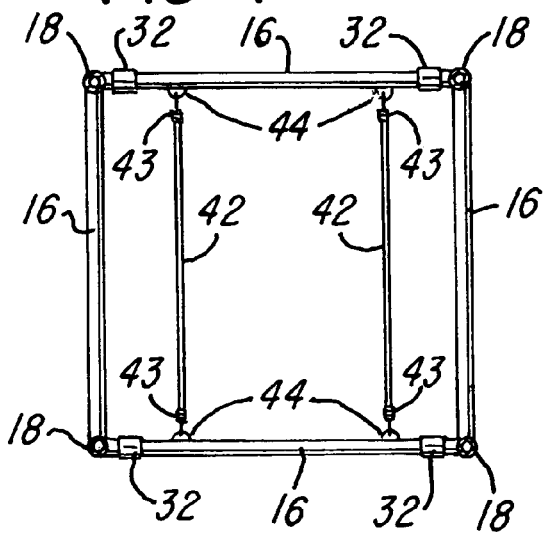
FIG. 4 is a section taken generally on the line 4-4 of FIG. 3, but without the ball shown in FIGS. 1-3.

FIGS. 2 and 3 show the top and side views of the apparatus 10 shown in FIG. 1. FIG. 2 illustrates that the ball 40 is surrounded by the frame 12 which is open in the front to allow the user to enter the apparatus and sit on the ball 40. FIG. 4 is a section showing the ball centering means in the form of two of the parallel spaced elastic rubber cords 42, which may be covered by tubular fabric. As mentioned above, the cords 42 have end portions attached by the hooks 43 to loops or rings 44 secured to the lower members 16 of the frame 12. The ball 40 is placed by the user in the chair frame 12, and the ball rests on the elastic cords 42. As the weight of the ball 40 depresses the elastic cords 42, the ball 40 moves to its lowest point, and the cords 42 center the ball 40 within the frame 12. After the user sits on the ball, the ball moves down and is supported by the floor F.

Figure 5:
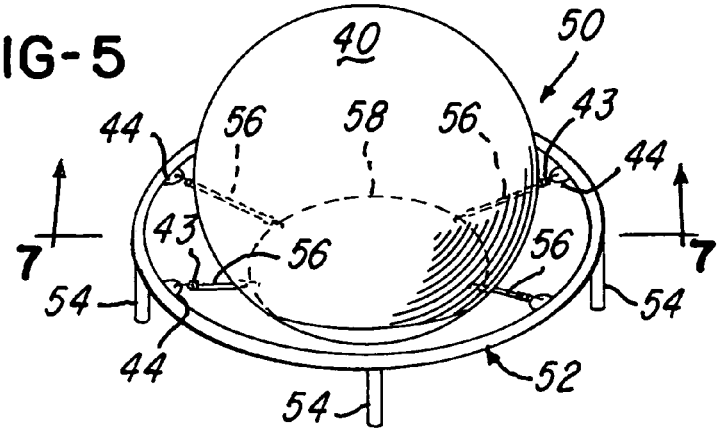
FIG. 5 shows a second embodiment of exercising apparatus constructed in accordance with the invention.
Figure 6:
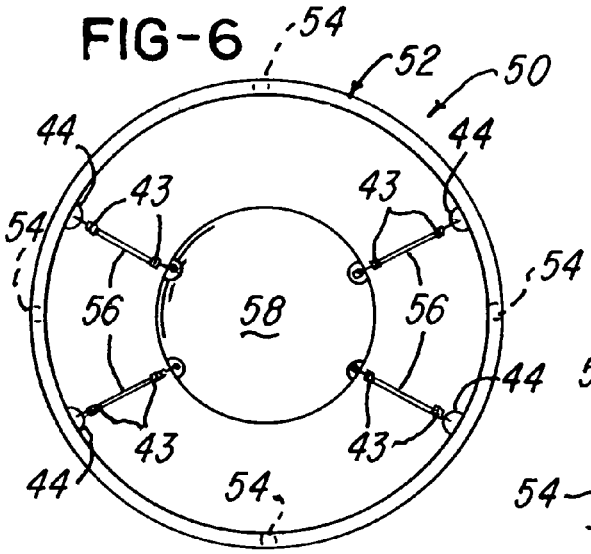
FIG. 6 is a top view of the apparatus shown in FIG. 5, but without a ball shown in FIG. 5.
Figure 7:
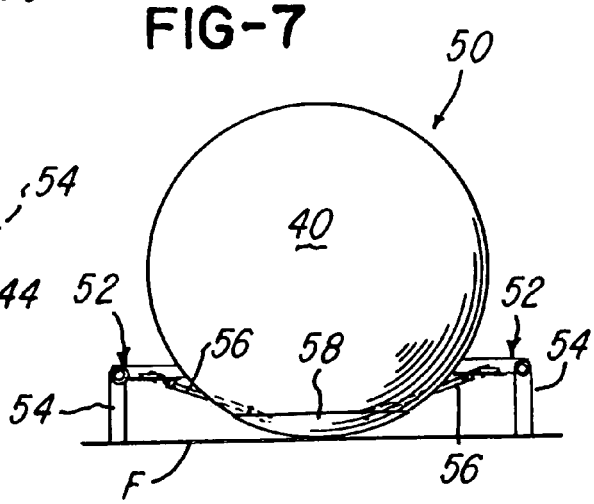
FIG. 7 is a section of the frame with the ball, taken generally on the line 7-7 of FIG. 5.

FIGS. 5-7 show another embodiment of exercise apparatus 50 constructed in accordance with the invention and which includes a circular tubular frame 52 supported by a set of four tubular legs 54 secured to the frame. The ball 40 is supported concentrically within the circular frame 52 by a set of four radially extending elastic straps or rubber cords 56 which have outer end portions connected to the frame 52 by the wire formed hooks 43 and loops 44 secured to the frame. The cords 56 have inner end portions connected by the wire formed hooks 43 to a circular center tray or pad 58 preferably formed of a flexible plastics sheet material or a woven fabric material. The elastic cords 56 and pad 58 cooperate to center the ball 40 normally within the surrounding circular frame 52. When a person or user sits on the ball 40, the elastic cords 56 stretch until the ball 40 and supporting center pad 58 contact the floor F, as shown in FIG. 7. The cords 56 and pad 58 provide for limited lateral rolling movement of the ball 40 within the annular space defined between the ball 40 and the frame 52.

Figure 8:
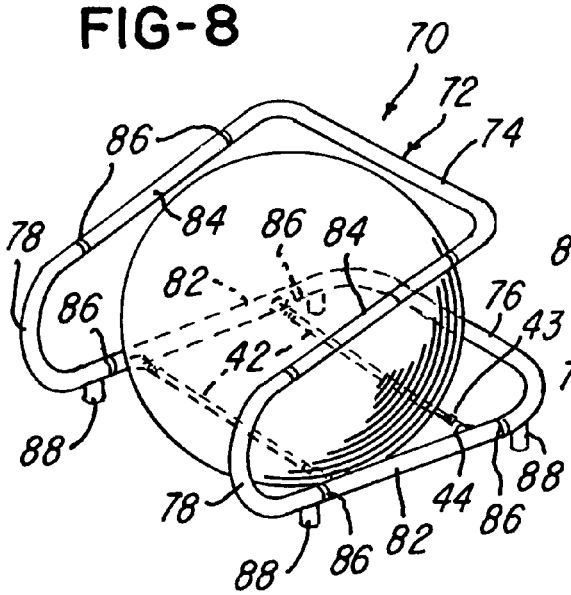
FIG. 8 shows a third embodiment of exercising apparatus constructed in accordance with the invention.
Figure 9:
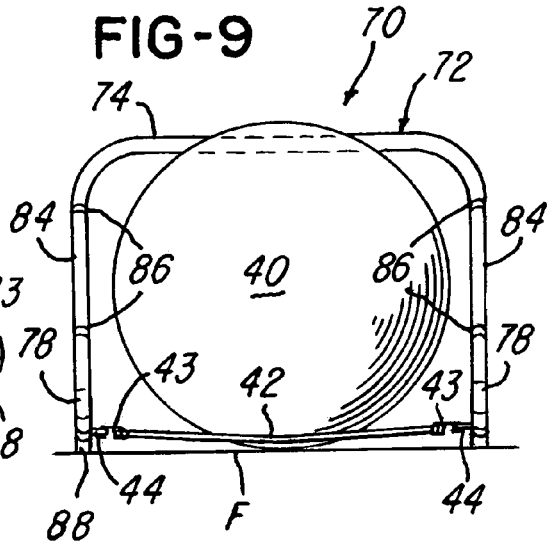
FIG. 9 is a front view of the exercising apparatus shown in FIG. 8.

Referring to FIGS. 8 and 9 which show another embodiment, an exercising apparatus 70 is constructed with a tubular metal or plastic frame 72 which also extends around the ball 40. The frame includes an upper U-shaped section 74 and a lower U-shaped section 76 which are rigidly connected by forward or front U-shaped sections 78, lower straight or linear sections 82 and upper straight or linear sections 84. The tubular sections are releasably connected together by sliding telescopic end portions or couplings which form joints 86. That is, some of the frame sections have a reduced end portion which telescopes into an opposing end portion of an adjacent section with a light press fit to form the rigid frame 72. The frame 72 has generally a wedge or V-shaped configuration with the bottom portion being horizontal and the upper portion being inclined. A set of resilient legs or pads 88 are secured to the end portions of the sections 76 and 78 to support the lower portion of the frame 72 spaced above the floor F, as shown in FIG. 9.

A pair of parallel spaced elastic or rubber straps or cords 42 have opposite end portions connected to the parallel linear sections 82 of the frame 72 by the wire formed hooks 43 and loops 44 secured to the frame sections 82. The cords 42 center the ball 40 laterally and also forwardly and rearwardly within the frame 72 on the floor F, as shown in FIG. 9. When a person or user sits on the ball 40, the cords 42 stretch until the bottom of the ball contacts or is supported by the floor. While the elastic cords 42 normally center the ball 40 within the frame 72, the cords 42 permit the ball to roll laterally, forwardly or rearwardly or horizontally in a universal manner in response to movement of the user's body.

While the forms of exercising apparatus herein described constitute preferred embodiments of the invention, it is to be understood that the invention is not limited to these precise forms of apparatus, and that changes may be made therein without departing from the scope and spirit of the invention as defined in the appended claims.

What is claimed is:

1. Exercising apparatus comprising a resilient ball adapted to support a person's body, a frame adapted to be supported by a floor surface and receiving said ball, said frame having frame members defining a horizontal space between said ball and said frame, said frame and said space providing for universal horizontal rolling movement of said ball within said frame without contacting said frame members when said ball is supporting the person's body and while said ball is supported within said frame, and said space also providing for vertical movement of said ball without contacting said frame members when said ball is supporting the person's body.

2. Exercising apparatus as defined in claim 1 and including an elastic member connected to said frame and supporting said ball within said frame.

3. Exercising apparatus as defined in claim 2 wherein said elastic member comprises at least two elastic cords normally supporting said ball in a generally center position.

4. Exercising apparatus as defined in claim 3 wherein each of said cords comprises an elastic rubber member surrounded by a fabric covering.

5. Exercising apparatus as defined in claim 1 wherein said frame comprises sections of rigid tubing, and releasable connections rigidly connecting at least some of said sections.

6. Exercising apparatus as defined in claim 1 wherein said frame comprises a set of rigid lower frame members spaced above the floor surface and defining an opening receiving said ball.

7. Exercising apparatus as defined in claim 6 wherein said frame includes a pair of generally parallel spaced rigid arm members spaced above parallel spaced said lower frame members and rigidly connected to said lower frame members.

8. Exercising apparatus as defined in claim 7 and including a rigid back frame member spaced above said lower frame members and rigidly connecting said arm members.

9. Exercising apparatus as defined in claim 8 wherein said back member supports a resilient back support cushion.

10. Exercising apparatus as defined in claim 1 wherein said frame comprises a generally circular frame surrounding said ball, a set of generally vertical legs supporting said circular frame above the floor surface, and a plurality of elongated elastic members normally supporting said ball generally concentrically within said frame with an annular said space between said ball and said frame.

11. Exercising apparatus as defined in claim 10 and including a center support pad under said ball and connected to said elastic members.

12. Exercising apparatus as defined in claim 1 wherein said frame comprises rigid tubing, and said frame has a U-shaped upper portion rigidly connected to a generally horizontal U-shaped lower portion by a pair of generally vertical end portions.

13. Exercising apparatus as defined in claim 12 wherein said portions of said frame comprise tubular frame sections releasably connected together by interfitting telescopic end portions of said tubular frame sections.

14. Exercising apparatus comprising a resilient ball adapted to support a person's body, a frame adapted to be supported by a floor surface and extending around said ball, said frame having frame members defining a horizontal space between said ball and said frame members, said space providing for limited and universal horizontal movement of said ball within said frame without contacting said frame members and while said ball is supporting the person's body within said frame, and elongated elastic members connected to said frame and supporting said ball spaced within said frame.

15. Exercising apparatus as defined in claim 14 wherein said elastic members comprise at least two elastic cords normally supporting said ball in an elevated position above the floor surface.

16. Exercising apparatus as defined in claim 14 wherein said frame comprises sections of rigid tubing, and releasable socket connections rigidly connecting at least some of said sections.

17. Exercising apparatus as defined in claim 1 wherein said frame includes a set of rigid lower frame members spaced above the floor surface, a pair of generally parallel spaced rigid arm members spaced above said lower frame members and rigidly connected to said lower frame members, and a rigid back frame member rigidly connecting said arm members.

18. Exercising apparatus as defined in claim 16 wherein said frame has a U-shaped upper portion rigidly connected to a generally horizontal U-shaped lower portion by a pair of generally vertical U-shaped end portions.

19. Exercising apparatus as defined in claim 14 wherein said frame comprises a generally circular frame surrounding said ball, a set of legs supporting said circular frame above the floor surface, and said elastic members normally supporting said ball generally concentrically within said frame to define an annular said space between said ball and said frame.

20. Exercising apparatus as defined in claim 19 and including a center support pad under said ball and connected to said elastic members.

21. Exercising apparatus comprising a resilient ball adapted to support a person's body, a frame adapted to be supported by a floor surface and receiving said ball, said frame having frame members defining a horizontal space between said ball and said frame, said frame members including horizontally spaced rigid arm members positioned above a center of said ball with said horizontal space therebetween, said frame and said space providing for universal horizontal rolling movement of said ball within said frame without contacting said frame members when said ball is supporting the person's body and while said ball is supported within said frame, and said space also providing for vertical movement of said ball without contacting said frame members when said ball is supporting the person's body.

22. Exercising apparatus as defined in claim 20 wherein each of said arm members supports a resilient arm support cushion.

* * * * *